US005462476A

United States Patent [19]

Bohn

[11] Patent Number: 5,462,476

[45] Date of Patent: Oct. 31, 1995

[54] BLADE SHARPENING DEVICE

[76] Inventor: Roy W. Bohn, Kifer Rd., P.O. Box 663, Milesburg, Pa. 16853

[21] Appl. No.: 360,869

[22] Filed: Sep. 8, 1994

[51] Int. Cl.[6] ..... B24B 7/00

[52] U.S. Cl. ..... 451/558; 451/552; 451/556; 451/555; 451/371; 451/380; 451/438

[58] Field of Search ..... 451/45, 367, 371, 451/378, 380, 414, 438, 552, 555, 556, 557, 558

[56] References Cited

U.S. PATENT DOCUMENTS 1,368,218 2/1921 Chenette ..... 451/458
5,185,958 2/1993 Dale ..... 451/558

*Primary Examiner*—Bruce M. Kisliuk
*Assistant Examiner*—Eileen P. Morgan
*Attorney, Agent, or Firm*—Thomas E. Sterling

[57] ABSTRACT

The blade sharpening device is an adjustable multi-angle edge sharpening unit comprised of a base connected to a rotatable sharpening stone table and a vertically adjustable blade support table. A hand movable sharpening stone is positioned on the sharpening stone table and the blade to be sharpened positioned on the blade support table, with the blade in grinding contact with the sharpening stone. An angle selection chart on the base allows vertical movement of the blade support table in conjunction with rotational adjustment of the sharpening stone table to accurately select a specific angle at which the blade edge is ground. A scissors adapter unit may be attached to the blade support table which permits the sharpening of scissors blades. The scissors blade is pressed against the scissors adapter, the blade being in grinding contact with the sharpening stone in much the same manner as knife blades are sharpened by the device.

11 Claims, 3 Drawing Sheets

Fig. 9.
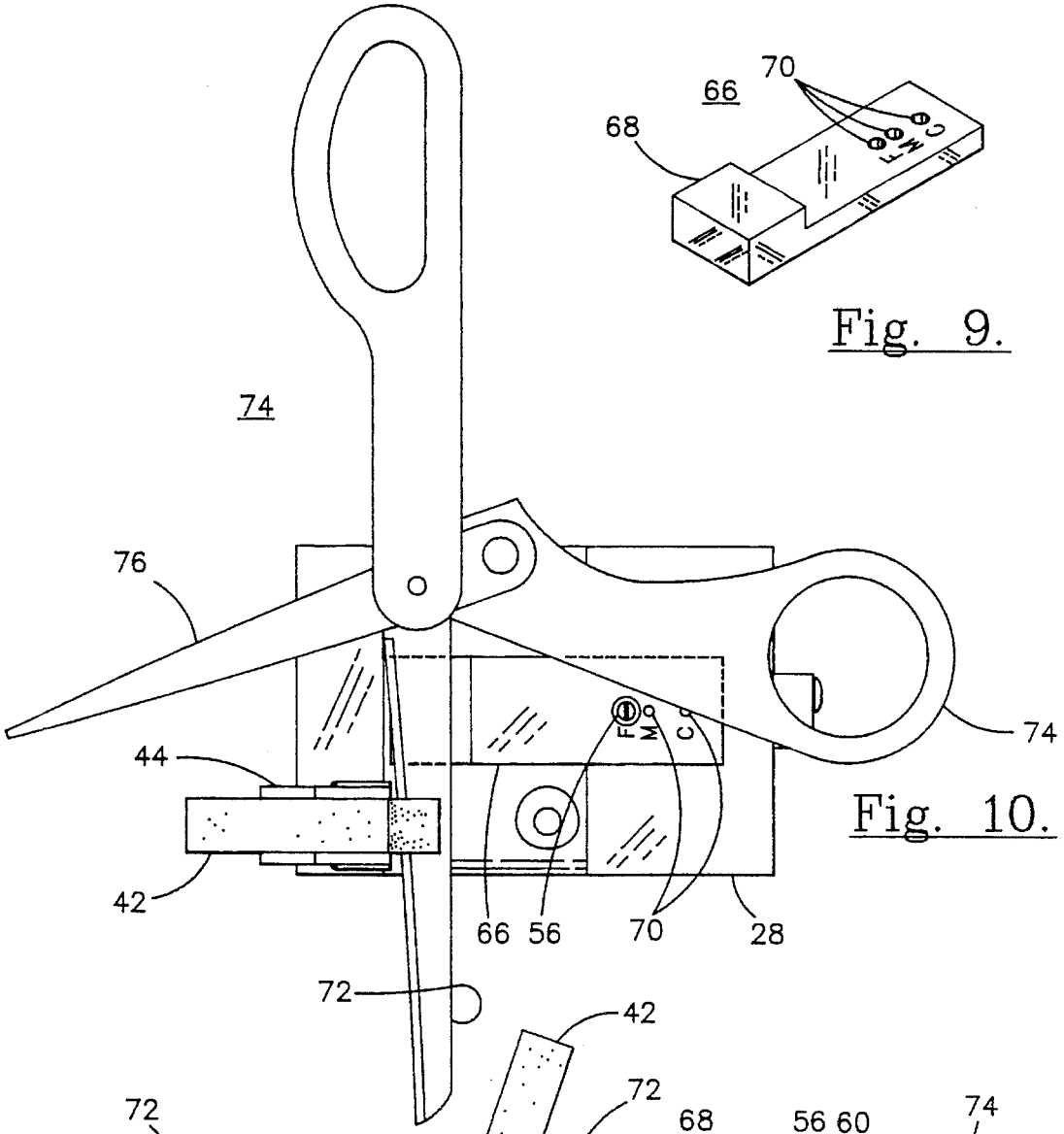
Fig. 10.
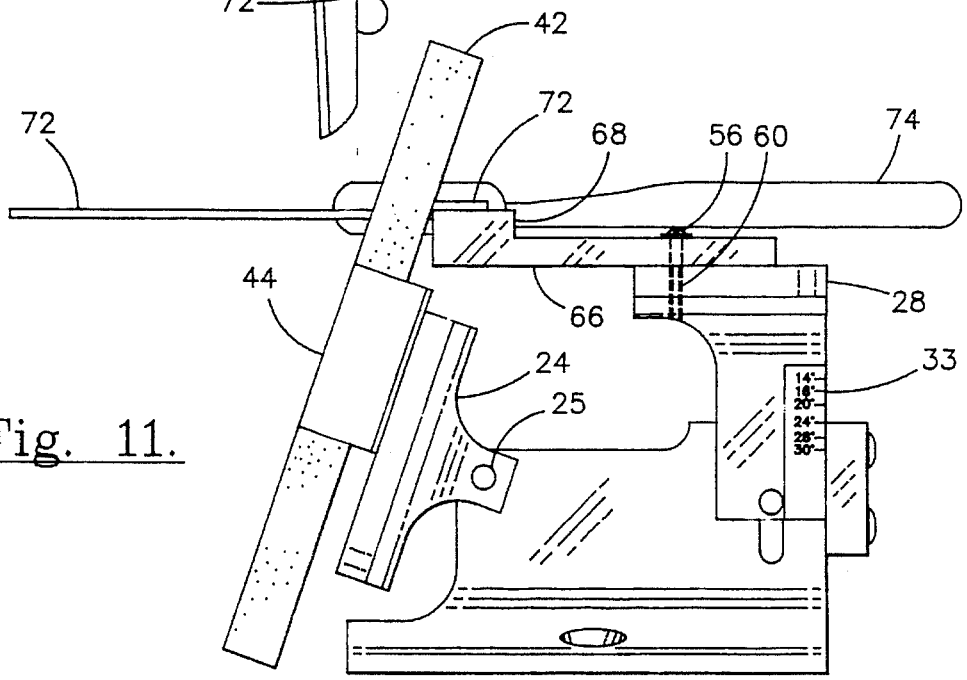
Fig. 11.

BLADE SHARPENING DEVICE

BACKGROUND OF THE INVENTION

1. Field of the Invention

This invention relates generally to a device for sharpening blades and the like. In particular this invention relates to a device for sharpening Broadhead inserts, planes, chisels, scissors and knives at an accurate, adjustable pre-determined angle.

2. Description of the Related Art

In the past there have been numerous manual blade and knife sharpening devices invented. There are many patents related to blade sharpening devices indicating the wide scope of such inventions. Many of these devices could not sharpen blades to a accurate pre-determined angle. Many would produce rounded edges and inaccurate blade sharpened angles. None have the advantages of the present invention.

The present invention allows a blade or knife to be sharpened at a range of selected angles to produce a smooth flat angle-accurate edge. The edge can be adjusted to a range of angles depending on the purpose for which the blade is intended. This angle may be adjusted to accomodate a range from the fragile edge of a broadhead arrow (14°) to the broad edge of planing knives and scissors(72°–85°). The invention utilizes a hand activated abrasive stone and a hand positioned blade to be sharpened. Scissors may also be sharpened by the attachment of a Scissors Adapter Device.

I, the inventor, know of no prior art which I consider to anticipate this invention. I am not witholding prior art which I consider to anticipate this invention.

SUMMARY OF THE INVENTION

The fixture if a multi-angle edge sharpening unit consisting of a frame and two connected tables. One table supports the blade. The other table supports the sharpening stone positioned at a selected angle.

The Blade Sharpening Device was designed by a professional wood carver to meet the requirements for truly sharp knives. The Blade Sharpening Device will deliver a perfect plane at whatever angle the fixture is set, by anyone, even if they have never sharpened a knife before. The correct angle is as easy as rubbing one flat surface against another. The edge is quickly achieved with a minimum removal of metal. Small thin blades, such as arrow broadhead inserts to draw knives, can easily be sharpened perfectly. The blade is completely supported and stone angle is fixed. By attaching a scissors adapter, scissors and shears may also be sharpened.

RECOMMENDED ANGLES FOR SHARPENING

The recommended angles for sharpening are:

14°—this angle gives a sharp but fragile edge, suitable for broad-heads, x-acto type knives;

16°—first choice for wood carvers and others who desire easy cutting edges;

20°—excellent for both long lasting but sharp service. Hunting knives, pocket knives;

28°—heavy edge for utility knives and other tools that see hard use;

30°—plane knives, chisels;

72°–85°—scissors, shears and the like.

The angles given are guidelines and may be changed to meet individual requirements.

The Blade Sharpening Device is supplied with two stones, one coarse and one fine. The coarse stone is used only the first time that a knife is sharpened on the fixture or if a nick has to be removed. This is a fast cutting stone that will quickly bring the edge on plane. The fine stone is used to impart the finished edge and touch-up the edge on knives previously sharpened on the Blade Sharpening Device. Archery broadheads and scissors may also be sharpened by procedures described later in this application.

PARTS OF FIXTURE

Blade Support Table: this has the angle chart on the lower right side.

Sharpening Stone Support Table: this part maintains the stone angle for the perfect edge each time.

Backing Plate: this part holds the knife support in alignment.

Base Section: this part has two holes provided for attaching to a bench or other surface if so desired.

Sharpening Stone Shoe: each stone is supplied with this part. The shoe holds the sharpening stone at the proper height and allows the sharpening stone to glide easily. The shoe must always be kept flat on the sharpening stone support table.

SET UP OF FIXTURE FOR KNIFE SHARPENING

1. Loosen, do not remove, slot bolt on side of blade support table with wrench provided. Align desired angle, on chart, with the top edge of the backing plate. While holding the blade support table firmly against the backing plate, tighten slot bolt.

2. Loosen, do not remove, screw on sharpening stone support table. Lay sharpening stone on sharpening stone support table with shoe in contact with sharpening stone support table with sharpening stone extending over edge of blade support table. Hold shoe in flat contact with sharpening stone support table and tilt sharpening stone support table until sharpening stone very lightly touches edge of blade support table. Tighten pivot bolts. SELECTED ANGLE IS NOW SET.

SHARPENING PROCEDURE

Hold knife in one hand and place blade flat on blade support table with edge to be sharpened parallel to edge of support. With other hand grasp shoe and place on sharpening support table so that the sharpening stone is laying over edge of knife. Maintain contact between shoe and sharpening stone support table. Keep both shoe and blade flat on fixture surfaces.

Honing action consists of stroking toward and away from blade. As one area of blade is brought onto plane move knife blade to present different areas until one side is complete. Holding knife in same hand, turn knife over and lay on fixture from opposite side. Continue honing as before. When edge is established, switch to fine stone for the finish honing.

To complete the edge strop on each side several strokes using a leather strop. This will remove any wire edges and impart the final edge.

SCISSORS ADAPTER

Scissors use a very steep angle and cut with a shearing action, by running one edge against another. Sometimes a small burr is rolled under. removal of this burr is essential to achieve a sharp edge. To remove the burr(s) place the stone flat against the inside edge of the blade. Use several light strokes with the #400 stone. Keep the stone flat against the blade. When burrs are removed from both blades proceed with sharpening on the fixture.

1. Set the knife support table at 24° on the chart. Align with the top edge of the backing plate, the same as for setting up for sharpening a knife.
2. Select a mounting hole on the adapter:
   F—Fine cutting such as hair, thread, thin material;
   M—Medium cutting such as paper, general use;
   C—Coarse cutting such as card stock, other thick materials.
3. Place mounting screw in chosen hole and affix to knife support table. hold adapter at right angle to knife support table and tighten screw.
4. The fixture should be placed near the edge of the table for stone clearance. For sharpening scissors the fixture works best when clamped or held with screws in the holes provided.
5. Loosen but do not remove screw in stone support and tilt to a vertical position. Place stone and shoe against table and tilt toward adapter. When the stone is lightly touching the adapter, tighten the screw. (The same procedure as used for setting fixture for knives.)
6. Open scissors and place one blade on the adapter with flat side down and the blade just overhanging the leading edge of the adapter. Proceed with sharpening the same as with knives. When one side is complete turn scissors over and place other blade on the adapter. Notice that unlike knives the blade remains on the same side of the fixture as the other blade. Sharpen as before.

SUGGESTIONS

A. After starting to sharpen the blade, stop and observe the angle closely. If the stone appears to be hitting at the top of the blade or at the bottom, watch that line. When the stone is hitting cleanly from top to bottom the blade is sharp.

B. Use the #220 stone first and do all the rough cutting with that stone. Then switch to the #400 stone. This will take only a few strokes to clean up the rough cuts left by the #200 stone.

C. Scissors are like chisels. They are sharpened on one side only. Keep the blade that is being sharpened flat on the adapter table. Move the blade parallel with the table in short sections. Do not try to sharpen the blade all at one time.

OBJECTS OF THE INVENTION

The object of this invention is to provide a blade sharpening device which will sharpen a blade at accurate predetermined angles.

Another object of this invention is to provide a device in which the blade is supported directly under the point of contact with the sharpening stone.

Still another object of this invention is to provide a sharpening device to eliminate flexing of thin blades and enabling the sharpening to be consistent.

Yet another object of this invention is to provide a device in which the blade and sharpening stone are hand held.

Another object of this invention is to provide a device which will sharpen a wide size of blades.

Still another object of this invention is to provide an attachable adapter with which scissors may be sharpened.

Yet another object of this invention is to provide a sharpening device whose sharpening angle can be duplicated from blade to blade.

BRIEF DESCRIPTION OF THE DRAWINGS

Other objects and advantages of the invention will become apparent upon reading the following detailed description and upon reference to the drawings in which:

FIG. 9 is a perspective view of the scissors adapter showing the adjustment holes therethrough;

FIG. 10 is a top view of the Blade Sharpening Device with the scissors adapter in position showing scissors in the sharpening position.

FIG. 11 is a side view of the Blade Sharpening Device with the scissor adapter in position showing scissors in the sharpening position.

SPECIFICATIONS

Figure 1:
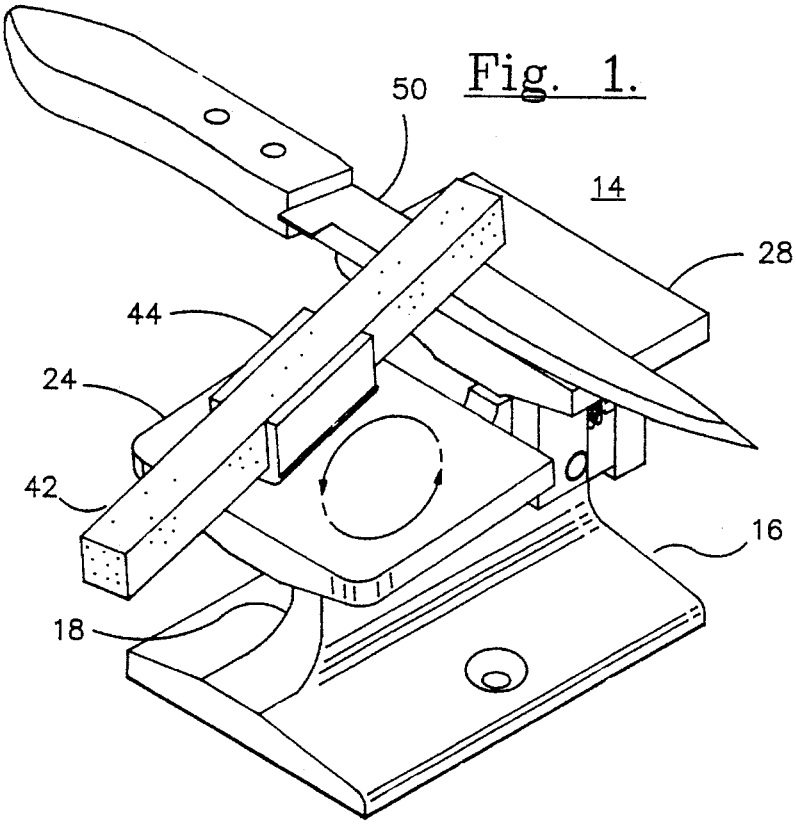
FIG. 1 is a perspective view of the Blade Sharpening Device with a knife in sharpening position on the blade support table and sharpening stone in sharpening position on the sharpening stone support table.
Figure 2:
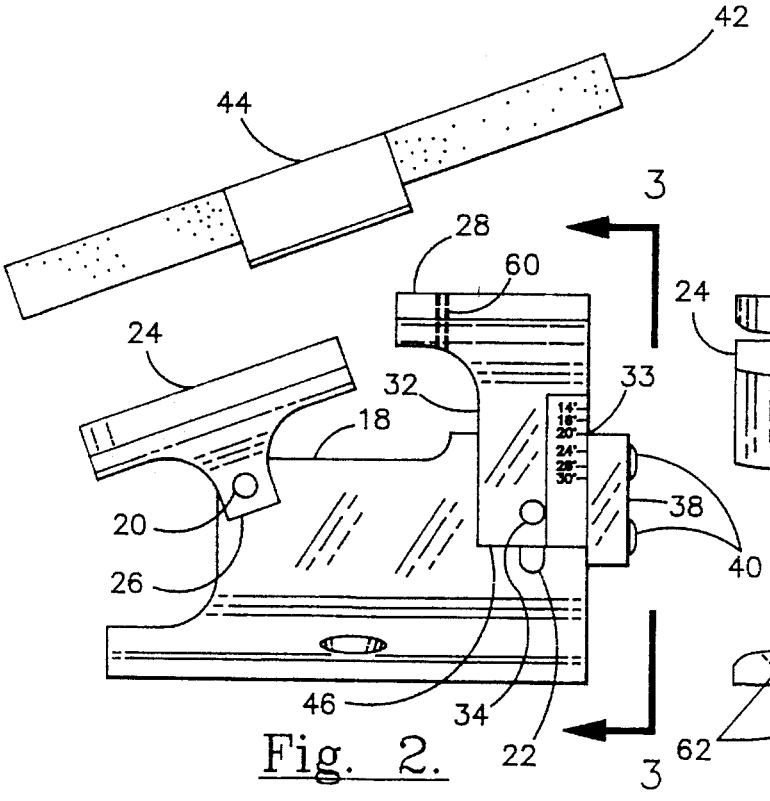
FIG. 2 is a side view of the Blade Sharpening Device showing the angle selection chart connected to the blade support table and the sharpening stone assembly.
Figure 3:
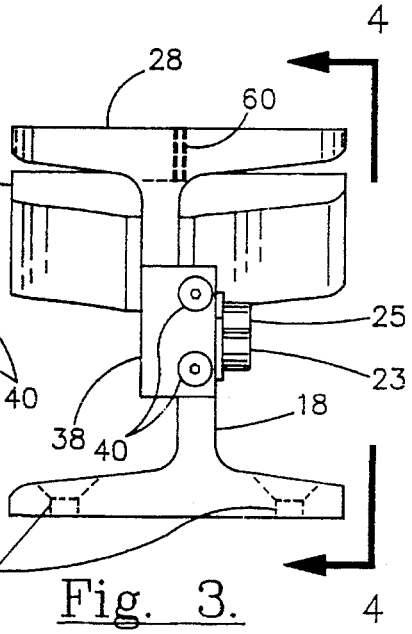
FIG. 3 is a back view of the Blade Sharpening Device showing the backing plate screw attached to the vertical section of the frame.
Figure 5:
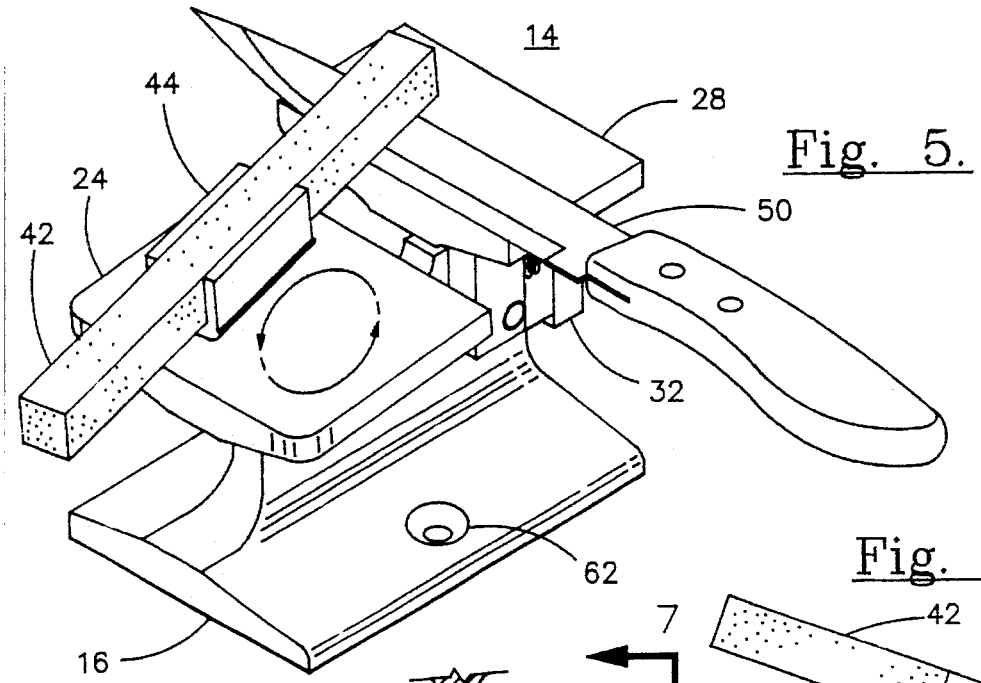
FIG. 5 is a perspective view of the Blade Sharpening Device having a knife positioned on the side opposite to the side shown in FIG. 1.

Turning now to the drawings, and in particular to FIGS. 1 & 5, 14 represents the Blade Sharpening Device of this invention.

The Blade Sharpening Device 14 is supported by a flat base section 16 having a vertical center section 18 extending the length of the base section 16. The vertical center section 18 has, at one end near the top, a pivot hole 20. A sharpening stone support table 24, later described, is attached to this pivot hole 20. At the opposite end of the vertical center section 18 and extending therethrough is a vertical slot 22 open at the top and terminating approximately half-way down the vertical center section 18. A blade support table 28, later described, is secured by a slot bolt and washer 23 to this slot 22.

The sharpening stone support table 24 is a rectangular flat platform having a downwardly extending tab 26 attached to the bottom portion thereof. Through this tab 26 is a tapped pivot hole 20 through which extends a pivot bolt 25 and washer & screw, in contact with vertical center section 18. When the sharpening stone support table 24 is in place, it is parallel to the flat base section 16. The sharpening stone support table 24 can be tilted through an arc of 0° horizontal to 90° vertical and clamped in position by tightening pivot bolt 25.

A rectangular blade support table 28 has a downwardly disposed angle selection tab 32 attached to the bottom portion thereof. This tab 32 has a tapped hole 34 therethrough and an angle selection chart 33 affixed thereon. The angle selection chart 33 has a list of angles and corresponding lines that are used for vertical positioning of blade support table 28. When in place, the blade support table 28 is able to be raised and lowered vertically in the vertical slot 22 to a selected angle on chart 33, The blade support table 28 remains parallel to the flat base section 16. A backing plate 38 is a small rectangular block that is screwed into the end of vertical section 18 by backing plate bolts 40. Backing plate 38 is used to maintain alignment of angle selection tab 32.

A square sharpening .stone 42 is clamped by a sharpening stone shoe 44 and positioned upon the top surface of blade support table 24. This shoe 44 clamps the sharpening stone 42 firmly at the proper height and allows the sharpening stone 42 to glide easily over the top surface of blade support table 24. The shoe 44 is made of a slippery substance such as ultra-high molecular weight polyethylene or other friction resistant substances which resist wear. The shoe 44 also eliminates wear to the sharpening support table 24 by insulating the sharpening stone 42 from the sharpening stone support table 24. In use, the slot bolt 23 secures the blade support table 28 in position.

Figure 4:
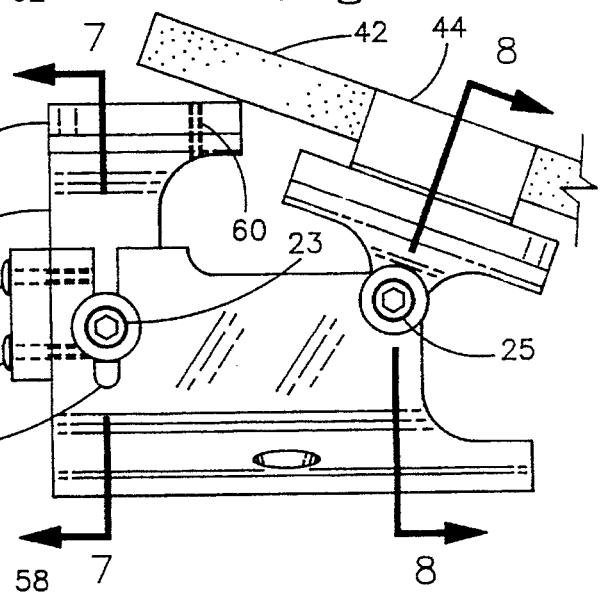
FIG. 4 is a view taken along line 4—4 of FIG. 3.
Figure 7:
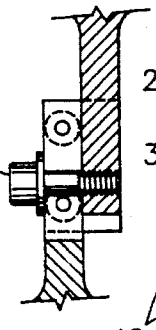
FIG. 7 is a view taken along line 7—7 of FIG. 4.

In operation, the sharpening stone 42 is clamped within the shoe 44 with the shoe 44 resting flat on the sharpening stone support table 24. The end of the sharpening stone 42 extends over the blade support table 28, (see FIG. 4). The sharpening stone support table pivot bolt 25 is then tightened holding the sharpening stone support table 24 in position. The blade 50 of a knife to be sharpened is then placed upon the blade support table 28 with the edge of the blade 50 slightly overhanging the blade support table 28 by about 1/32nd of an inch.

The sharpening stone 42 is then dipped in oil. The sharpening stone 42 is placed on the table, within shoe 44, and extends over the knife blade 50 in grinding contact therewith. Flat contact is maintained with the shoe 44 and the sharpening stone support table 24, (see FIG. 1 and FIG. 5). A stroking or circular motion is used to hone the edge of the knife blade 50. As the edge of the knife blade 50 comes into plane, the knife blade 50 is moved to hone the entire edge. The knife blade 50 is then reversed in position on the blade support table 28 and the other side of the knife blade 50 is sharpened, (see FIG. 5).

Figure 6:
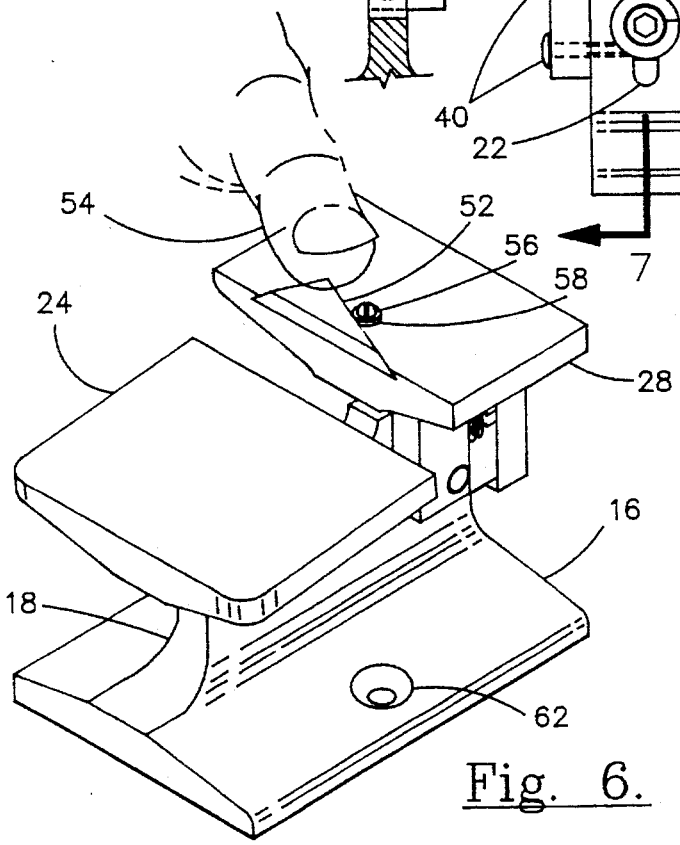
FIG. 6 is a perspective view of the Blade Sharpening Device with a archery broadhead arrow insert in sharpening position on the blade support table in contact with a broadhead retaining screw and washer.
Figure 8:
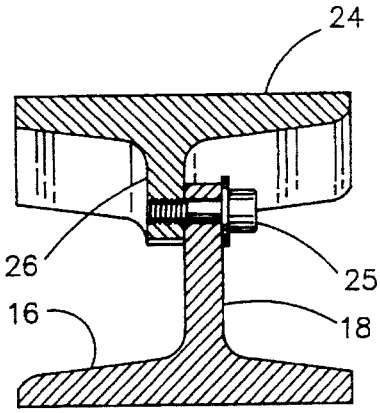
FIG. 8 is a view taken along line 8—8 of FIG. 4.

Frequently it is necessary to sharpen the points of archery broadhead arrows, inserts or other thin blades. Such points are thin, small and difficult to hold. FIG. 6 illustrates a modification of the invention that permits this sharpening to be easily done. 52 represents a broadhead arrow point or insert held flat upon blade support table 28 by a finger 54. A button head screw 56 and encircling washer 58 is thread attached to tapped hole 60 in the top of blade support table 28. Tapped hole 60 is close enough to the edge of blade support table 28 that broadhead arrow point 52 or insert will jam against screw washer 58, finger 54 holding it in position. The broadhead arrow point 52 or insert is then ground by sharpening stone 42 manually moved in an alternating manner by hand,

SCISSORS ADAPTER

This invention may be modified to sharpen scissors by attaching a scissors adapter 66 to the blade support table 28. Referring now to FIGS. 9, 10 and 11, and in particular to FIG. 9, scissors adapter 66 is of a general rectangular shape having a raised portion at one end which serves as a scissors blade support 68. The opposite end portion of the scissors adapter 66 has three longitudonally spaced holes 70 therethrough marked F (fine—72°), M (medium—77°) and C (coarse—85°). The holes 70 allow the scissors adapter 66 to be attached to tapped hole 60 in blade support table 28 by button-head screw 56. Button-head screw 56 extends through one of holes 70 and into tapped hole 60 engaging the screw tapping therein. Button-head screw 56 clamps the scissors adapter 66 firmly in place by screw engagement, against blade support table 28.

In operation the user selects a single hole of holes 70 depending upon the sharpening angle he desires, Fine, Medium or Coarse. Button-head screw 56 is inserted in the selected hole 70 and button-head screw screwed into tapped hole 60 and tightened. The angle selection chart 33 is set at 24°. These grinding angles may be varied by changing the longitudonal location of hole 70. The grinding angle may also be varied by appropriate adjustment of the angle set on selection chart 33. Hence the grinding angle may be varied to angles between 72°–85° as well as angles less than 72° and greater than 85°.

To set the scissors adapter 66, rotate stone support table 24 on pivot bolt 25 with sharpening stone shoe 44 and sharpening stone 42 thereon. Allow sharpening stone 42 to just touch scissors blade support 68, then clamp it to place by pivot bolt 25. Sharpening stone 42 is then set at the proper angle. The selected angle is: 72°—Fine (F), 77°—Medium (M) or 85°—Coarse (C). The flat side of scissors blade 72 of scissors 74 is placed on scissors blade support 68 and held in position by the user.

In operation, the user then moves the sharpening stone 42 with reciprocating motion in contact with the scissors blade 72, and advances the scissors blade 72 until it is sharpened the entire length. This procedure is similar to that previously described for knives. The other scissors blade 76 of scissors 74 is similarly sharpened.

Although this invention has been described with a certain degree of particularity, many modifications are possible without departing from the spirit of the invention.

I claim:

1. A blade sharpening device comprising:

a base member with a groove therethrough;

a blade support table movably attached to said base member and clampable to said base member and having a generally horizontal, flat, upper surface for holding a blade member;

a sharpening stone support table having a substantially flat surface and being pivotally attached to said base member;

a sharpening stone shoe positioned on said substantially flat surface of said stone support table;

a sharpening stone positioned in said shoe and when extended to contact said blade forms an angle with said horizontal surface;

an angle selection chart attached to said blade support table adapted to indicate the angle between said sharpening stone and said blade support table, whereby said sharpening stone may be moved in any direction on said substantially flat surface and in contact with said blade to sharpen said blade.

2. The blade sharpening device as claimed in claim 1 which said sharpening stone support table has a clamping bolt therethrough extending through said base member and screw attached to said sharpening stone support table:

whereby the angle of said sharpening stone support table may be rotatably adjusted and clamped to said base member by said clamping bolt.

3. The blade sharpening device as claimed in claim 2 in which an angle adjusting bolt extends through groove in said base member and is in screw engagement with said blade support table.

4. The blade sharpening device as claimed in claim 3 having:

a blade stop, screwably attached to said blade support table;

whereby a broadhead arrow point may be finger positioned against said blade stop and in grinding relationship with said sharpening stone.

5. The blade sharpening device as claimed in claim 3 having a scissors adapter attached to said blade support table and extending outwardly therefrom whereby a scissors blade may be held in manual contact with said scissors adapter and in grinding contact with said sharpening stone.

6. The blade sharpening device as claimed in claim 5 in which said scissors adapter is comprised of in combination:

a raised scissors blade support element on one end portion and an attachment hole therethrough;

clamping means extending through said attachment hole and into said blade support table.

7. The blade sharpening device as claimed in claim 6 in which said clamping means is a screw.

8. The blade sharpening device as claimed in claim 3 in which sharpening stone table is adjustable to blade grinding angles from 14° to 30° inclusive.

9. The blade sharpening device as claimed in claim 6 in which said scissors adapter adjustment has two or more holes therethrough which may be longitudonally positioned to scissors grinding angles from 72° to 85° inclusive.

10. The blade sharpening device as claimed in claim 3 in which said shoe is made of a friction resistent substance.

11. The blade sharpening device as claimed in claim 10 in which said shoe is made of high molecular weight polyethylene plastic.

* * * * *